US011506216B2

(12) United States Patent
Arnoldi et al.

(10) Patent No.: US 11,506,216 B2
(45) Date of Patent: Nov. 22, 2022

(54) WATER PUMP

(71) Applicant: HANON SYSTEMS EFP DEUTSCHLAND GMBH, Bad Homburg v. d. Höhe (DE)

(72) Inventors: Ernesto Giovanni Arnoldi, Luserna S. Giovanni (IT); Paolo Lincoln Maurino, Bagnolo Piemonte (IT)

(73) Assignee: HANON SYSTEMS EFP DEUTSCHLAND GMBH, Bad Homburg (DE)

( * ) Notice: Subject to any disclaimer, the term of this patent is extended or adjusted under 35 U.S.C. 154(b) by 0 days.

(21) Appl. No.: 17/257,899

(22) PCT Filed: Jul. 11, 2019

(86) PCT No.: PCT/DE2019/200075
§ 371 (c)(1),
(2) Date: Jan. 5, 2021

(87) PCT Pub. No.: WO2020/011316
PCT Pub. Date: Jan. 16, 2020

(65) Prior Publication Data

US 2021/0270272 A1 Sep. 2, 2021

(30) Foreign Application Priority Data

Jul. 11, 2018 (DE) ..... 10 2018 211 541.9

(51) Int. Cl.
*F04D 29/043* (2006.01)
*F04D 13/06* (2006.01)
(Continued)

(52) U.S. Cl.
CPC ..... *F04D 29/043* (2013.01); *F04D 13/026* (2013.01); *F04D 13/06* (2013.01);
(Continued)

(58) Field of Classification Search
CPC .... F04D 13/06; F04D 13/026; F04D 13/0606; F04D 29/426; F04D 13/0633;
(Continued)

(56) References Cited

U.S. PATENT DOCUMENTS 4,722,661 A * 2/1988 Mizuno ..... F04D 13/026 310/106
6,607,370 B2 * 8/2003 Fukamachi ..... F04D 13/027 417/420
7,891,958 B2 * 2/2011 Sakai ..... F04D 13/16 417/370
8,282,367 B2 * 10/2012 Ihle ..... F04D 29/5893 310/86
(Continued)

FOREIGN PATENT DOCUMENTS

DE 102007016255 B4 11/2012
DE 102011079226 A1 1/2013
(Continued)

OTHER PUBLICATIONS

Chinese Office Action regarding Patent Application No. 2019800450856, dated Jul. 27, 2022.

*Primary Examiner* — Peter J Bertheaud
(74) *Attorney, Agent, or Firm* — Harness, Dickey & Pierce, P.L.C.

(57) ABSTRACT

A water pump with an impeller driven by an electrical machine comprising a housing cap and a volute with an inlet) and an outlet and a boot hosting a stator and a rotor of the electrical machine, wherein the rotor is mounted on a fixed shaft in the water pump having a bushing rotatable mounted on the shaft.

5 Claims, 2 Drawing Sheets

(51) Int. Cl.

| | |
|---|---|
| ***F04D 13/08*** | (2006.01) |
| ***F04D 29/22*** | (2006.01) |
| ***F04D 29/42*** | (2006.01) |
| ***F04D 13/02*** | (2006.01) |
| ***F04D 29/02*** | (2006.01) |

(52) U.S. Cl.
CPC ..... *F04D 13/0606* (2013.01); *F04D 13/0633* (2013.01); *F04D 13/08* (2013.01); *F04D 29/026* (2013.01); *F04D 29/22* (2013.01); *F04D 29/426* (2013.01); *F05D 2210/11* (2013.01); *F05D 2240/50* (2013.01); *F05D 2300/224* (2013.01); *F05D 2300/43* (2013.01); *F05D 2300/516* (2013.01)

(58) Field of Classification Search
CPC ..... F04D 29/026; F04D 29/043; F04D 29/22; F04D 13/08; F05D 2210/11; F05D 2240/50; F05D 2300/224; F05D 2300/43; F05D 2300/516
See application file for complete search history.

(56) References Cited

U.S. PATENT DOCUMENTS

| | | | | |
|---|---|---|---|---|
| 8,353,687 | B2 * | 1/2013 | Werson | H02K 21/24 417/423.1 |
| 8,753,068 | B2 * | 6/2014 | Matsunaga | F04D 13/0633 415/104 |
| 9,360,015 | B2 | 6/2016 | Muizelaar et al. | |
| 2007/0286723 | A1 | 12/2007 | Ihle et al. | |
| 2011/0305562 | A1 | 12/2011 | Matsunaga et al. | |
| 2017/0298946 | A1 | 10/2017 | Weiske | |
| 2019/0109516 | A1 | 4/2019 | Bernreuther | |

FOREIGN PATENT DOCUMENTS

| | | | |
|---|---|---|---|
| DE | 102013014139 | A1 | 6/2014 |
| DE | 102013018840 | B3 | 10/2014 |
| DE | 112013003549 | B4 | 12/2016 |
| EP | 1850010 | A2 | 10/2007 |
| EP | 2980415 | A1 | 2/2016 |
| EP | 3232065 | A1 | 10/2017 |
| EP | 03467317 | A1 | 4/2019 |
| WO | 2008072438 | A1 | 6/2008 |

* cited by examiner

WATER PUMP

CROSS-REFERENCE TO RELATED APPLICATIONS

This application is a U.S. National Phase Application under 35 U.S.C. 371 of International Application No. PCT/DE2019/200075, filed on Jul. 11, 2019, which claims the benefit of German Patent Application No. 10 2018 211 541.9, filed on Jul. 11, 2018. The entire disclosures of each of the above applications are incorporated herein by reference.

FIELD

The disclosure is related to a water pump with an impeller driven by an electrical machine comprising a housing cap and a volute with an input and an output and a boot hosting a stator and a rotor of the electrical machine mounted on a shaft.

BACKGROUND

This section provides background information related to the present disclosure which is not necessarily prior art.

Generally, water pumps include a stator and rotor. The rotor is in communication with an impeller for moving a fluid. The fluid enters the pump through an inlet in a volute, contacted with an impeller and moved through an outlet in the volute. The rotor and stator are contained with a housing that connects with the volute. Generally, the rotor and stator are separated by a magnetic air gap and the rotor and stator include rare earth metals so that magnetic air gap between the rotor and stator may be bridged so that the rotor is rotated during use and so that the rotor, the stator, or both may be isolated from the fluids during use and continue to operate. However, the use of rare earth metals may be damaged by the fluid such that the rare earth metals may require additional packaging so that damage is prevented.

U.S. Pat. No. 9,360,015 B1 discloses an electric water pump, and more specifically an electric water pump having an improved wet sleeve so that the water pump is free of a housing. The electric water includes a pump rotor having a shaft. A wet sleeve surrounds the rotor and has a cap, a sleeve that houses the rotor, and a seat in communication with the shaft of the rotor so that the seat assists in supporting the shaft a stator. Surrounding the wet sleeve and the rotor is a volute covering an upper portion of the rotor, wet sleeve, and stator. The electric water pump further includes a rubber boot covering a lower portion of the rotor, wet sleeve, and stator and is in communication with the volute forming a cover.

SUMMARY

This section provides a general summary of the disclosure, and is not a comprehensive disclosure of its full scope or all of its features.

The objective of the disclosure is to provide a water pump with an optimized design reducing wear.

The solution provided is a water pump with an impeller driven by an electrical machine comprising a housing cap and a volute with an input and an output and a boot hosting a stator and a rotor of the electrical machine, wherein the rotor is mounted on a fixed shaft in the water pump having a bushing rotatable mounted on the shaft.

The advantages of using a bushing are a long durability of the components and of the pump as consequence.

It is advantageous that the bushing has first length covering the shaft in the area of the rotor and second length covering the shaft extending into the volute. Especially, the bushing covers the shaft in the area of the entire length of the rotor of the electrical machine, and especially in the area of its laminated core. In other words, the bushing is longer than the rotor of the electrical machine, since it is not only formed in the area of the rotor, but also extends into the volute.

With the total length of bushing a good bearing surface is achieved for the rotor.

The bushing is machined or sintered in steel or molded by polymer material or produced with carbon material.

This materials and processes result in a high precision bushing with reduced free play with consequent advantages on noise and vibration.

It is an advantage that the bushing and/or the shaft have a "self-lubricating" surface which means a surface with reduced friction coefficient to reduce friction. The self-lubricating surface is a coating or a function of bushing material so that the rotor can run in dry conditions for more than one hour without damages.

In a preferred embodiment the bushing is used in a design where the stator stack is overmolded with a first plastic material and at least the stator stack, the wires and pins are overmolded with a second plastic material to form a cylindrical ring boot.

This allows a device assembly with reduced parts and reduced effort. Due to the fact that part are completely over molded the heat transfer is better. This also due to the fact that dimension can be reduced and the weight of the water pump is lower compared to standard die casted pumps. The pump has a high resistance to vibrations.

It is advantageous that the electronic board is over molded together with the stator in a method to produce the water pump. The volume of air trapped in the compartment of the electronic board is reduced for increasing the heat transfer and reducing the overall volume.

DRAWINGS

The drawings described herein are for illustrative purposes only of selected embodiments and not all possible implementations, and are not intended to limit the scope of the present disclosure.

The disclosure is described in the figures and the following description.

Corresponding reference numerals indicate corresponding parts throughout the several views of the drawings.

DETAILED DESCRIPTION

Figure 1:
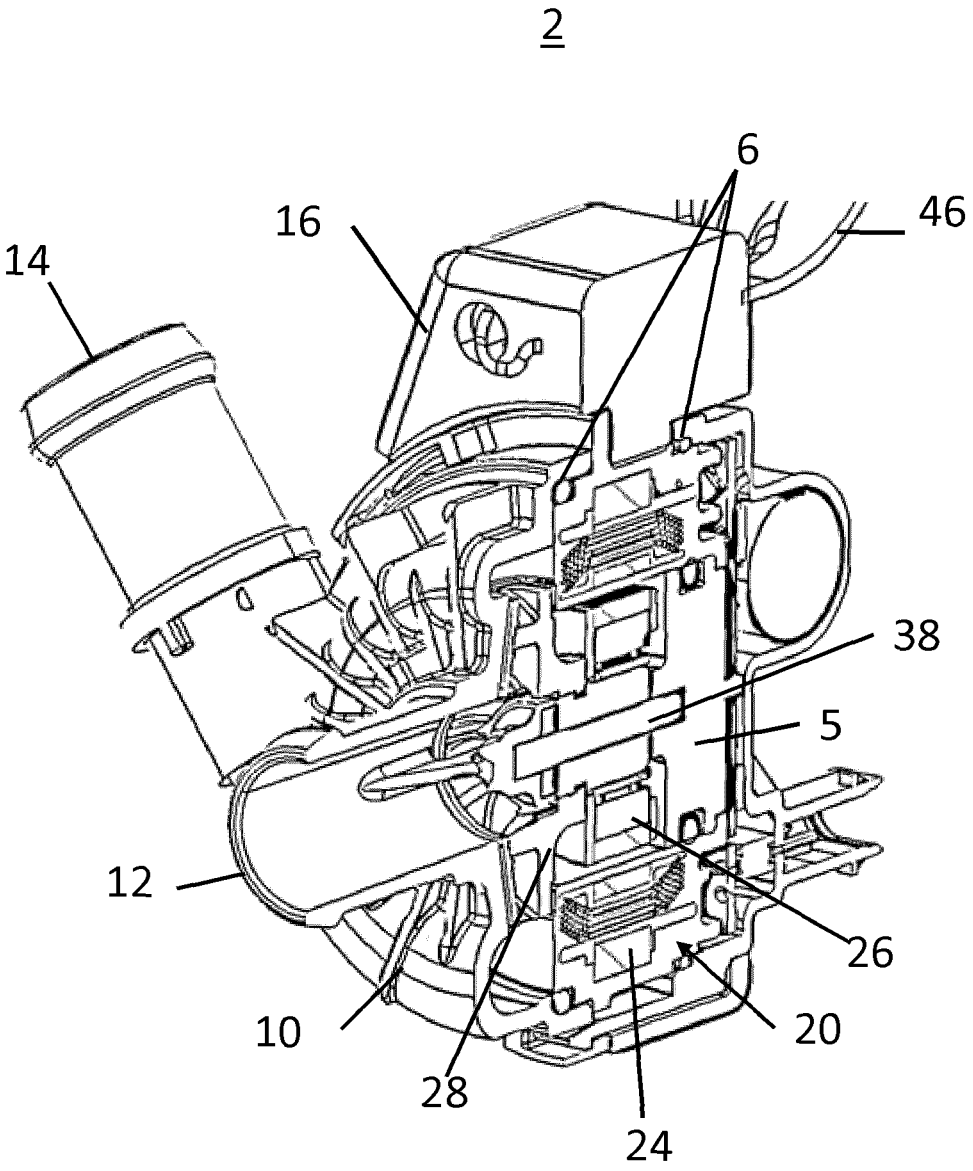
FIG. 1 shows a water pump according the disclosure.
Figure 2:
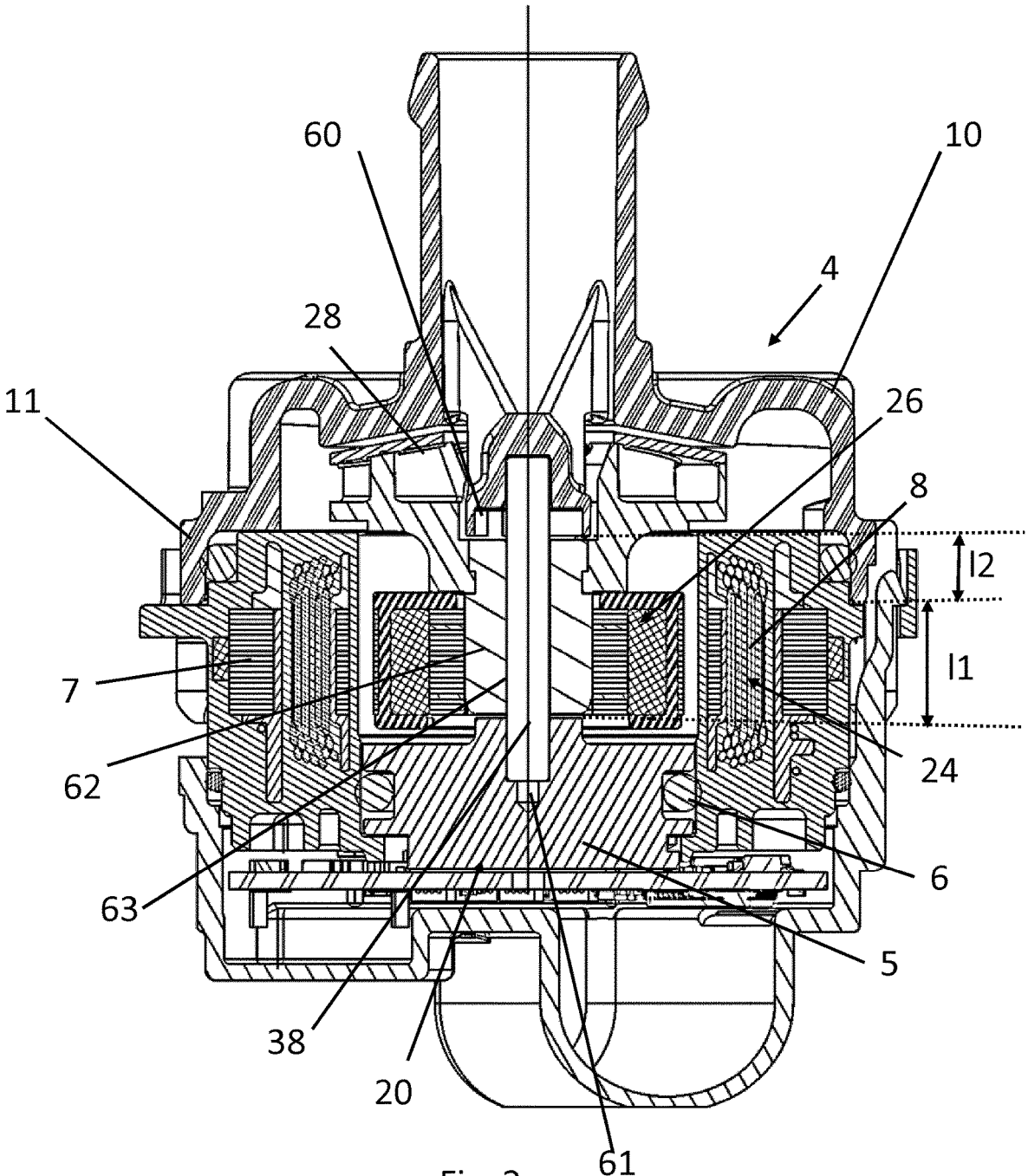
FIG. 2 shows a cross section of the water pump.

Example embodiments will now be described more fully with reference to the accompanying drawings.

The water pump 2 includes a volute 10, a boot 20 and a band clamp attaching the boot 20 and the volute 10. The volute 10 includes an inlet 12 and an outlet 14. The volute includes a power supply connection.

The volute 10 is connected to a boot 20 via the band clamp or any other connector forming a cover 4, which encompasses the internal components and includes a power supply connection 16 for housing a supply line 46. The internal components of the water pump 2 include a stator 24 that is in one embodiment press fit into the boot 20. The stator 24 surrounds a rotor 26. The rotor 26 and the stator 24 are separated by a magnetic air gap. The rotor 26 includes d an impeller 28 for moving a fluid as the fluid enters the inlet 12. The impeller 28 moves the fluid through the outlet 14 for use.

A preferred embodiment of the water pump is designed with reduced parts.

The pump 2 has a boot 20 that combines different functions: the boot defines the outer circumference of the pump, covers the stator 24 and a wet sleeve function and hosts the rotor 26. A heat sink 5 is mounted in the boot 20 wherein a rotor shaft 38 is seated. A sealing 6 in form of an O-ring seals the heat sink 5 versus the inner circumference of the boot 20 in an opening 50.

The boot 20 has the form of a cylindrical ring with the cylindrical opening 50 inside. In the ring the devices of the stator are located in the opening the rotor 26 is mounted around the shaft 38.

The pump boot is prepared by over molding the stator 24 that eliminates air gaps between the different components as stator stack 7, supply pins 9 and copper wires 8. The over molding increases the heat dissipation of the stator.

The stator stack 7 is over molded during the process.

The shaft 38 is fixed in the housing either by a snap ring 60 in the volute 10 and/or by overmolding in the boot area 61.

The fixed shaft 38 is surrounded by a bushing 62 that is machined or sintered with high precision. The bushing 62 is covering the cylindrical surface 63 of the shaft 38 at least in the first length I1 facing the stator and a second length I2 extending into the volute 10. The first length I1 corresponds to the length of the rotor 26 of the electric machine.

The total length of I1+I2 allows a good bearing and an optimized rotation. The bushing 62 rotates around the shaft 38 being lubricated by a surface coating or a self-lubricant material applied on the shaft 38 or the bushing 62 or both. Rotor 26 is fixed on the bushing 62 and this rotating module consisting of rotor 26 and bushing 62 is mounted together on the fixed shaft 38.

For the bushing 62 is made with tight tolerances the water pump 2 runs with less noise and vibrations.

Alternatively the bushing is made by polymer or carbon materials that have self-lubricating behaviors and reduced wear.

The foregoing description of the embodiments has been provided for purposes of illustration and description. It is not intended to be exhaustive or to limit the disclosure. Individual elements or features of a particular embodiment are generally not limited to that particular embodiment, but, where applicable, are inter-changeable and can be used in a selected embodiment, even if not specifically shown or described. The same may also be varied in many ways. Such variations are to be regarded as a departure from the disclosure, and all such modifications are intended to be included within the scope of the disclosure.

The invention claimed is:

1. A water pump with an impeller driven by an electrical machine, comprising:

a housing cap;

a volute with an inlet and an outlet;

a boot hosting a stator and a rotor of the electrical machine, wherein the stator includes wires and pins and the rotor is mounted on a fixed shaft in the water pump; the rotor having a bushing rotatably mounted on the shaft, wherein the bushing has a first length covering the shaft in an area of the rotor, and wherein the bushing has a second length covering the shaft extending into the impeller; and a heat sink mounted in the boot, wherein the shaft is seated in the heat sink, wherein the stator is overmolded with a first plastic material and at least the stator, wires and pins are overmolded with a second plastic material to form the boot in the shape of a cylindrical ring.

2. The water pump according to claim 1, wherein the bushing is machined or sintered or molded by polymer material or produced with carbon material.

3. The water pump according to claim 1, wherein the bushing and/or the shaft have a surface with reduced friction coefficient.

4. The water pump according to claim 3, wherein the surface with reduced friction coefficient is a coating or a function of bushing material.

5. The water pump according to claim 1, wherein an electronic board is over molded together with the stator.

* * * * *